United States Patent [19]

Davis et al.

[11] 4,292,918

[45] Oct. 6, 1981

[54] APPARATUS FOR APPLYING LIQUID CHEMICALS TO A MOVING WEB

[75] Inventors: Gayron N. Davis, Opelika; Larry S. Sellers, Shawmut, both of Ala.; Winston E. Hagborg, Columbus, Ga.

[73] Assignee: West Point Pepperell, Inc., West Point, Ga.

[21] Appl. No.: 171,826

[22] Filed: Jul. 22, 1980

Related U.S. Application Data

[63] Continuation-in-part of Ser. No. 110,454, Jan. 8, 1980, abandoned.

[51] Int. Cl.[3] ..... B05C 3/18

[52] U.S. Cl. ..... 118/33; 118/415; 68/202

[58] Field of Search ..... 118/33, 235, 268, 260, 118/407, 412, 413, 415; 68/200, 202; 427/356; 425/224

[56] References Cited

U.S. PATENT DOCUMENTS

| | | | |
|---|---|---|---|
| 3,007,200 | 11/1961 | Paulsen et al. | 118/407 X |
| 3,587,525 | 6/1971 | Fleischer | 118/415 X |
| 3,903,843 | 9/1975 | Jones | 118/412 |
| 3,930,465 | 1/1976 | Schuierer | 118/325 |
| 4,165,211 | 8/1979 | Ebeling et al. | 425/224 |

*Primary Examiner*—John P. McIntosh
*Assistant Examiner*—Bernard F. Plantz
*Attorney, Agent, or Firm*—Cushman, Darby & Cushman

[57] ABSTRACT

In a preferred embodiment of the invention, a manifold in the form of a pipe having a closed end is utilized to supply a finishing agent to orifices arranged at spaced intervals along the pipe. A foam material surrounds the manifold to receive the finishing agent and to apply it in a thin film to the curved surface of an element comprising a longitudinal section of a cylinder. The film is retained on the curved surface by surface tension as it moves under the force of gravity to a longitudinal edge of the cylindrical section. A web of fabric is tensioned against the section edge as the fabric moves past the cylindrical section. The direction of fabric movement is such that the film of finishing agent is applied to the fabric immediately ahead of the line of contact between the fabric and the section edge.

14 Claims, 3 Drawing Figures

APPARATUS FOR APPLYING LIQUID CHEMICALS TO A MOVING WEB

This application is a continuation-in-part of application Ser. No. 110,454, filed Jan. 8, 1980, and now abandoned.

BACKGROUND OF THE INVENTION

While the present invention relates generally to apparatus for applying liquid chemicals to various types of moving webs, it is particularly suitable for applying finishing agents to fabrics. Accordingly, in the description to follow, the utility of the invention in finishing fabrics will be highlighted.

Typically, a fabric is impregnated with a finishing agent, which comprises an aqueous solution of finishing chemicals, by means of a conventional padder. With such apparatus, the treated fabric contains approximately 70% moisture. As a result, a drying operation must be performed to drive off the excess moisture. With a moisture content as high as 70%, a considerable amount of energy is required to accomplish the necessary drying.

Utilizing the present invention, it has been found that finishing agents can be applied to a fabric utilizing a substantially higher concentration of finishing chemicals in the aqueous solution than is possible with conventional techniques. Consequently, the moisture content of the treated fabric is substantially reduced to approximately half the level heretofore achieved. This results in an important and significant improvement in the amount of energy required to dry the fabric.

SUMMARY OF THE INVENTION

The foregoing results are achieved by an apparatus comprising a closed end pipe having a plurality of orifices arranged along its length. The finishing agent is introduced to the open end of the pipe and is discharged through the orifices to a foam which surrounds the pipe. The foam is engaged by a fixed member comprising a longitudinal section of a cylinder. The foam supplies a thin film of finishing agent to the curved surface of the fixed member. Under the force of gravity the film moves to an edge of the cylindrical section against which a web of fabric is tensioned as it moves past the fixed member. The direction of movement of the fabric is such that the finishing agent is applied to the fabric immediately upstream of the line of contact between the fabric and the section edge. Consequently, on engaging the edge, the finishing agent is forced into the fabric.

DETAILED DESCRIPTION OF THE INVENTION

The invention will be described in detail with respect to the accompanying drawings wherein.

Figures 1, 2:
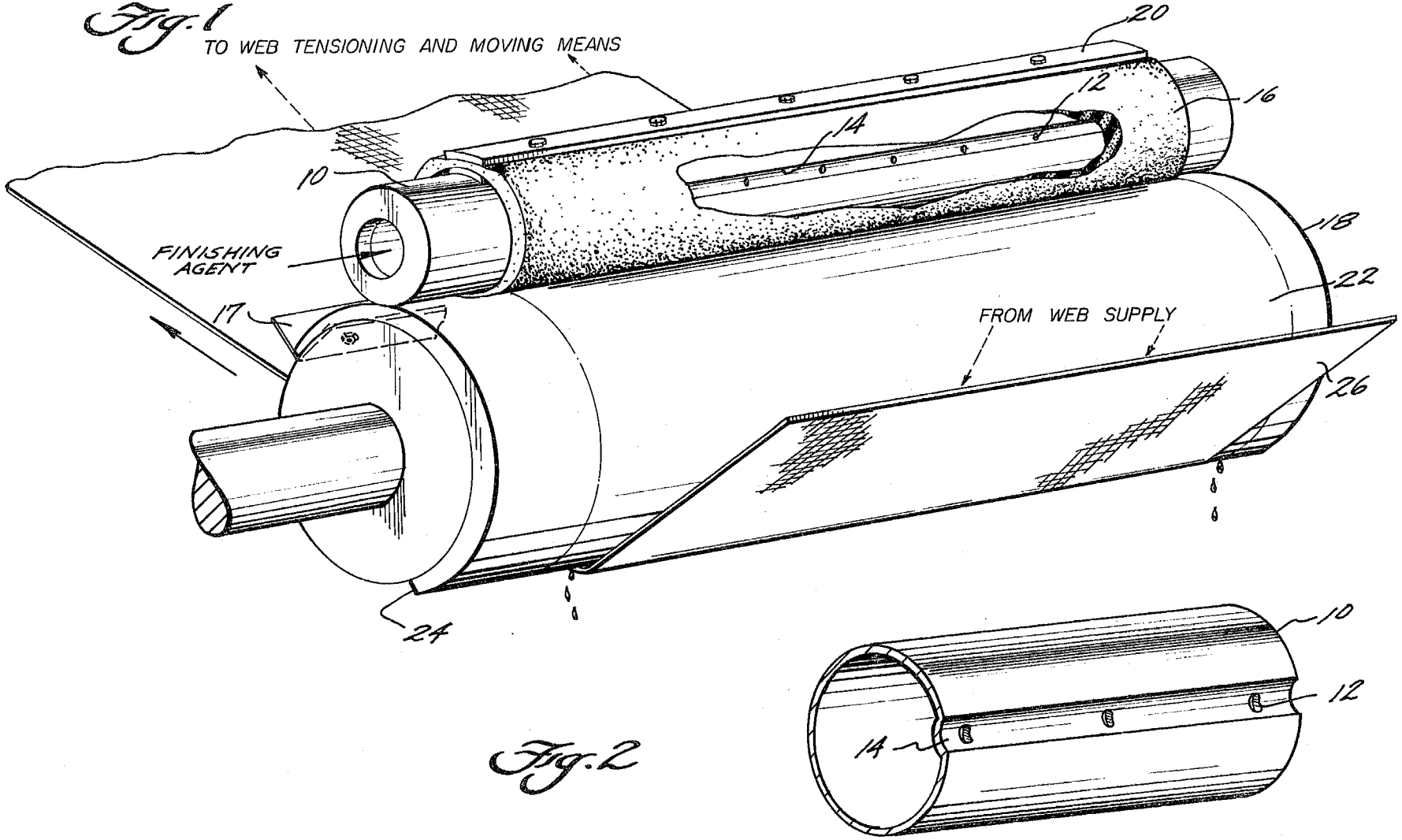
FIG. 1 is a perspective view of a preferred embodiment of the invention.
FIG. 2 is an enlarged view of a section of the manifold which comprises a portion of the invention.
Figure 3:
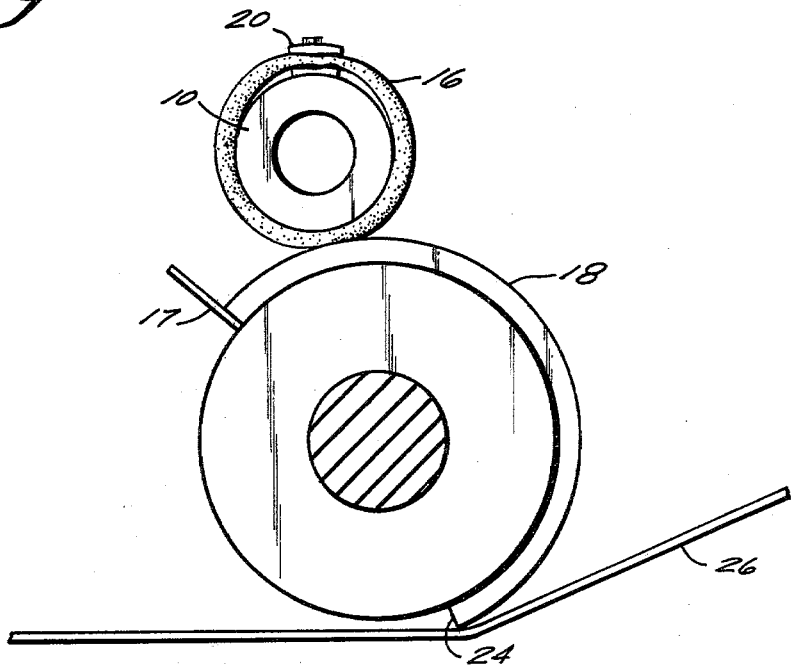
FIG. 3 is an end view of the arrangement shown in FIG. 1.

Referring to the drawings, a manifold is illustrated which comprises a pipe 10 open at one of its ends to receive a solution containing finishing chemicals and closed at its opposite end. Preferably, the solution is directed to the manifold by a flow controller (not shown) which contains a centrifugal pump which supplies a head pressure through a filter to a throttling valve. A rotometer is used to measure the flow rate to the manifold so that the throttling valve may be adjusted to obtain the correct flow rate for the particular fabric involved and the speed at which it moves past the finishing apparatus.

In the preferred embodiment, the manifold is a $1\frac{1}{4}''$ stainless steel pipe at least as long as the width of the web of fabric being finished. A plurality of orifices 12 are provided along the pipe at spaced intervals, e.g., orifices of 1/16" diameter located 1" apart. The closed end of pipe 10 causes the build-up of a back pressure against the flow controller. Consequently, an identical amount of finishing agent is discharged from each of the orifices 12. So as to spread the distribution of the finishing agent along the manifold, a groove 14 interconnects orifices 12. Typically, the groove is about $\frac{1}{8}''$ wide and 0.1" deep.

Preferably, the manifold is surrounded by hydrophilic polyurethane foam 16 which absorbs and disperses the jet streams of finishing agent. Typically, the porosity of the foam is adequate to allow gravitational seepage of finishing agent and yet dense enough to dissipate the jet streams from orifices 12 into a smooth even flow of liquid the full width of the foam.

However, any porous material such as felt, fabric or metal screens or wire mesh may be used to smooth the liquid flow, in place of the polyurethane foam. Baffles may also be used for this purpose.

In the preferred embodiment, a fixed member 18 is secured to the foam 16 and pipe 10 by a conventional clamping arrangement 20 which also causes a seal to be formed at their juncture with the compressed foam acting as a gasket. In the event of leakage rearward past said juncture, a trough 17 diverts any drippage produced from falling on the treated fabric below. Member 18 comprises a longitudinal section of a cylinder—preferably a half cylinder of stainless steel having a $4\frac{1}{2}''$ outside diameter and a wall thickness of 0.250". The member 18 is associated in contacting relationship with the foam 16 so that as the finishing agent seeps through the foam, a thin film 22 of the agent forms on member 18, flows horizontally over the crest, and under the force of gravity, the film (maintained by surface tension on member 18) moves along the curved surface of member 18 towards the longitudinally extending edge 24 thereof.

A web of fabric 26 is tensioned against edge 24 as it is transported by the finishing apparatus in the direction shown by the arrowhead. For convenience of illustration, the conventional transporting apparatus has been omitted from the drawings. The direction of movement of the fabric is such that the film 22 of finishing agent is applied thereto upstream of the line of contact between the fabric and edge 24. Consequently, edge 24 serves to force the finishing agent within the fabric.

The portions of film 22 extending beyond the edges of the web 26 cause a build-up of finishing agent along the end segments of edge 24. The accumulating liquid drips into a reservoir (not shown) from which it may be recirculated to the flow controller.

After being treated with the finishing agent, the fabric is dried and cured in a stenter. However, since the solution of finishing agent applied by the apparatus is of considerably higher concentration than is employed by conventional finishing applicators, a substantially less amount of energy is required to dry the fabric.

While the apparatus has been described as treating a fabric with a finishing agent, other chemical solutions such as dyes, binders, reducing agents and oxidizing agents can also be applied with the invention. Additionally, as has been indicated previously, while the invention is particularly effective in applying chemical solutions to a fabric, the apparatus is suitable for use in applying liquid chemicals to other types of moving webs, such as papers, films and the like.

What is claimed is:

1. Apparatus for applying a liquid chemical to a movable web, comprising:

a manifold for receiving and discharging said chemical, said manifold including a pipe to receive said chemical, said pipe being provided with a plurality of spaced orifices located along its length for discharging the chemical;

a length of porous material positioned along said manifold adjacent the orifices for receiving and dissipating the jets of chemical discharged by the manifold;

a fixed member engaging said porous material and having a curved surface terminating in a straight edge, said member being oriented with respect to the porous member such that the chemical is transferred to the member from the porous material, said chemical moving under the force of gravity as a thin film along said curved survace to said edge; and means for tensioning the web against said edge and for moving the web with respect to the fixed member whereby said chemical is applied to the web.

2. Apparatus as set forth in claim 1, wherein said manifold further includes a longitudinal groove interconnecting said orifices.

3. Apparatus as set forth in claim 1, wherein said porous material is a foam surrounding said manifold.

4. Apparatus as set forth in claim 3, wherein said foam is polyurethane.

5. Apparatus as set forth in claim 1, wherein said fixed member comprises a longitudinal section of a cylinder.

6. Apparatus as set forth in claim 5, wherein said fixed member is a half cylinder.

7. Apparatus as set forth in claim 6, wherein said fixed member engages the porous material substantially diametrically opposite the straight edge.

8. Apparatus as set forth in claim 1, wherein said web is moved in a direction whereby the chemical is applied to wet the web prior to the wetted web engaging said straight edge.

9. Apparatus for applying a liquid chemical to a movable web, comprising:

a manifold for receiving and discharging said chemical, said manifold including a pipe to receive said chemical, said pipe being provided with a plurality of spaced orifices located along its length for discharging the chemical;

a length of porous material surrounding said manifold for receiving and dissipating the jets of the chemical discharged by the manifold;

a fixed member comprising a longitudinal section of a cylinder which engages said porous material, said member being oriented with respect to the porous material such that the chemical is transferred to the member from the porous material and moves under the force of gravity as a thin film along said curved surface to a straight longitudinal edge of said cylindrical section; and means for tensioning the web against said edge and for moving the web with respect to the fixed member in a direction whereby the chemical is applied to wet the web prior to the wetted web engaging said straight edge.

10. Apparatus as set forth in claim 9, wherein said manifold further includes a longitudinal groove interconnecting said orifices.

11. Apparatus as set forth in claim 9, wherein said porous material is a polyurethane foam.

12. Apparatus as set forth in claim 9, wherein said fixed member is a half cylinder which engages the porous material substantially diametrically opposite the straight edge.

13. Apparatus as set forth in claim 12, wherein said manifold further includes a longitudinal groove interconnecting said orifices and wherein said porous material is a polyurethane foam.

14. Apparatus as set forth in claim 9, whereby said cylindrical section engages the porous material along a line substantially parallel to said longitudinal edge of the section, said line being located at an elevation below that of a crest of the cylindrical section located between said line and the section edge, said chemical building up on the cylindrical section between said line and the crest and then passing over the crest before descending under the force of gravity to said edge.

* * * * *